US006822386B2

(12) United States Patent
Derraa

(10) Patent No.: US 6,822,386 B2
(45) Date of Patent: Nov. 23, 2004

(54) FIELD EMITTER DISPLAY ASSEMBLY HAVING RESISTOR LAYER

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/260,987

(22) Filed: Mar. 1, 1999

(65) Prior Publication Data

US 2003/0001489 A1 Jan. 2, 2003

(51) Int. Cl.[7] ..... H01J 1/304

(52) U.S. Cl. ..... 313/495; 315/169.1

(58) Field of Search ..... 313/495, 496, 313/497, 309, 310, 311, 351, 336; 315/169.1

(56) References Cited

U.S. PATENT DOCUMENTS

| | | | |
|---|---|---|---|
| 3,485,658 A | 12/1969 | Iller | |
| 3,789,471 A | 2/1974 | Spindt et al. | 445/50 |
| 4,407,695 A | 10/1983 | Deckman et al. | |
| 4,410,562 A | 10/1983 | Nemoto et al. | 427/54.1 |
| 4,513,308 A | 4/1985 | Greene et al. | 357/55 |
| 4,522,910 A | 6/1985 | Hallman | 430/157 |
| 4,627,988 A | 12/1986 | Spanjer | 427/5 |
| 4,752,353 A | 6/1988 | Blanding et al. | 156/660 |
| 5,153,483 A | 10/1992 | Kishino et al. | |
| 5,191,217 A | 3/1993 | Kane et al. | 250/423 |
| 5,200,847 A | 4/1993 | Mawatari et al. | |
| 5,220,725 A | 6/1993 | Chan et al. | |
| 5,229,331 A | 7/1993 | Doan et al. | |
| 5,245,248 A | 9/1993 | Chan et al. | |
| 5,357,172 A | 10/1994 | Lee et al. | |
| 5,372,973 A | 12/1994 | Doan et al. | |
| 5,391,259 A | 2/1995 | Cathey et al. | |
| 5,399,238 A | 3/1995 | Kumar | |
| 5,448,133 A | 9/1995 | Ise | 313/497 |
| 5,484,314 A | 1/1996 | Farnworth | |
| 5,510,156 A | 4/1996 | Zhao | |

(List continued on next page.)

FOREIGN PATENT DOCUMENTS

| | | |
|---|---|---|
| FR | 2750533 | 1/1998 |
| JP | 7-94076 | 4/1995 |
| JP | 10021820 | 1/1998 |
| JP | 10134740 | 5/1998 |
| WO | WO 98/08243 | 2/1998 |

OTHER PUBLICATIONS

S. Itoh et al.; "A Challenge to Field Emission Displays"; ITE 15$^{th}$ International Display Research Conference, Oct. 16–18, 1995; 5 pages.

A. Ghis et al.; "Sealed Vaccum Devices: Fluorescent Microtip Displays"; IEEE Transactions on Electron Devices, Oct. 1991, vol. 38, No. 10; pp. 2320–2322.

Website—www.stmediagroup.com by ST MediaGroup entitled "*Screen Printing*"; Feb. 14, 2002; 1p.

(List continued on next page.)

*Primary Examiner*—Nimeshkumar D. Patel
*Assistant Examiner*—Karabi Guharay
(74) *Attorney, Agent, or Firm*—Wells St. John P.S.

(57) ABSTRACT

Field emitter display (FED) assemblies and methods of forming field emitter display (FED) assemblies are described. In one embodiment, a substrate is provided having a column line formed and supported thereby. A plurality of field emitter tip regions are formed and disposed in operable proximity to the column line. At least some of the regions define different pixels of the display. A continuous resistor is interposed between the column line and at least two different pixels. In another embodiment, a column line is formed and supported by a substrate. A plurality of field emitter tip regions are formed and disposed in operable proximity to the column line. The regions define different pixels of the display. A single current-limiting resistor is operably coupled with the column line and at least two different pixels.

29 Claims, 11 Drawing Sheets

U.S. PATENT DOCUMENTS 5,563,470 A 10/1996 Li
5,576,594 A 11/1996 Toyoda et al. ..... 313/309
5,585,301 A 12/1996 Lee et al.
5,598,057 A 1/1997 Vickers
5,621,272 A 4/1997 Levine et al. ..... 445/24
5,633,560 A 5/1997 Huang
5,642,017 A 6/1997 Hush
5,644,195 A 7/1997 Browning
5,652,181 A 7/1997 Thakur
5,655,940 A 8/1997 Hodson et al.
5,660,570 A 8/1997 Chan et al.
5,661,531 A 8/1997 Greene et al.
5,663,742 A 9/1997 Hush
5,676,853 A 10/1997 Alwan
5,695,658 A 12/1997 Alwan ..... 216/42
5,712,534 A 1/1998 Lee et al.
5,726,530 A 3/1998 Peng
5,754,149 A 5/1998 Browning et al.
5,789,851 A 8/1998 Turlot et al.
5,808,401 A * 9/1998 Jin et al. ..... 313/309
5,817,373 A 10/1998 Cathey et al. ..... 427/458
5,818,153 A 10/1998 Allen ..... 313/306
5,828,163 A * 10/1998 Jones et al. ..... 313/309
5,866,979 A 2/1999 Cathey, Jr. et al. ..... 313/496
5,871,870 A 2/1999 Alwan ..... 430/5
5,889,361 A * 3/1999 Wang et al. ..... 313/336
5,894,188 A * 4/1999 Chakvorty et al. ..... 313/309
5,975,975 A 11/1999 Hofmann et al. ..... 445/24
5,990,612 A 11/1999 Konuma ..... 313/495
6,002,199 A * 12/1999 Spindt et al. ..... 313/309
6,020,683 A 2/2000 Cathey, Jr. et al. ..... 313/497
6,022,256 A 2/2000 Rolfson ..... 445/24
6,107,728 A * 8/2000 Spindt et al. ..... 313/310
6,130,106 A 10/2000 Zimlich ..... 438/20
6,137,219 A 10/2000 Song et al. ..... 313/497
6,144,144 A * 11/2000 Cleeves et al. ..... 313/309
6,201,343 B1 * 3/2001 Spindt et al. ..... 313/310
6,225,732 B1 * 5/2001 Chakvorty et al. ..... 313/309
6,228,538 B1 5/2001 Michiels et al. ..... 430/5
6,252,348 B1 6/2001 Lee ..... 313/495
6,255,771 B1 * 7/2001 Jones et al. ..... 313/306
6,380,877 B2 * 4/2002 Castaneda et al. ..... 341/154
6,465,241 B2 * 10/2002 Haronian et al. ..... 435/287.2
6,480,013 B1 * 11/2002 Nayler et al. ..... 324/754

OTHER PUBLICATIONS

*Material Science and Engineering 621.02: Experiment 5: Silk screening of Ag paste and Ag/AgCl onto Carbon Films*: Dr. Marc J. Madow: http://www.ets.com/browse/nonogen/home/classes/MSE621.02/lab5.html pp. 1–2 (1999).

S. Wolf,*Silicon Processing for the VLSI Era—vol. II*, 1990, pp. 104–105.

Website—http://nuclear.hazard.uiuc.edu entitled "*Screen Printing—Overview*", Feb. 14, 2002; pps. 1–4 provided.

Website—www.usscreen.com entitled "*Basic Printing Techniques 101*", by Scott Fresener, Feb. 18, 2002; pps. 1–5.

Website—http://tasp.home.tesax.net/educ.html entitled "*Solutions Journal—Insight, Advice & Lessons Learned*": Feb. 18, 2002: pps. 1–9.

Website—www.screen.com entitled "*ScreenWeb—The Internet's Largest Screen Printing Resource*"; Feb. 18, 2002; pps. 1–2.

Website—www.usscreen.com entitled "*U.S. Screen Printing Institute*"; Feb. 18, 2002; pps. 1–2.

Website—http://search.yahoo.com entitled "*Yahoo! 1 Source Screen Printing*", Feb. 18, 2002: pps. 1–4.

*Generation of Charged Liquid Cluster Beam of Liquid–Mix Precursors and Application to Namostructural Materials*, K. Kim and C.K. Ryu, May, 1994, pp. 597–602.

* cited by examiner

FIELD EMITTER DISPLAY ASSEMBLY HAVING RESISTOR LAYER

GOVERNMENT RIGHTS

This invention was made with United States Government support under contract No. DABT63-97-C-0001 awarded by the Advanced Research Projects Agency (ARPA). The United States Government has certain rights in this invention.

TECHNICAL FIELD

This invention relates to field emitter display (FED) assemblies, and to methods of forming field emitter display (FED) assemblies.

BACKGROUND OF THE INVENTION

Flat-panel displays are widely used to visually display information where the physical thickness and bulk of a conventional cathode ray tube is unacceptable or impractical. Portable electronic devices and systems have benefitted from the use of flat-panel displays, which require less space and result in a lighter, more compact display system than provided by conventional cathode ray tube technology.

The invention described below is concerned primarily with field emission flat-panel displays or FEDs. In a field emission flat-panel display, an electron emitting cathode plate is separated from a display face or face plate at a relatively small, uniform distance. The intervening space between these elements is evacuated. Field emission displays have the outward appearance of a CRT except that they are very thin. While being simple, they are also capable of very high resolutions. In some cases they can be assembled by use of technology already used in integrated circuit production.

Field emission flat-panel displays utilize field emission devices, in groups or individually, to emit electrons that energize a cathodoluminescent material deposited on a surface of a viewing screen or display face plate. The emitted electrons originate from an emitter or cathode electrode at a region of geometric discontinuity having a sharp edge or tip. Electron emission is induced by application of potentials of appropriate polarization and magnitude to the various electrodes of the field emission device display, which are typically arranged in a two-dimensional matrix array.

Field emission display devices differ operationally from cathode ray tube displays in that information is not impressed onto the viewing screen by means of a scanned electron beam, but rather by selectively controlling the electron emission from individual emitters or select groups of emitters in an array. This is commonly known as "pixel addressing." Various displays are described in U.S. Pat. Nos. 5,655,940, 5,661,531, 5,754,149, 5,563,470, and 5,598,057 the disclosures of which are incorporated by reference herein.

FIG. 1 illustrates a cross-sectional view of an exemplary field emission display (FED) device 10. Device 10 comprises a face plate 12, a base plate 14, and spacers 16 extending between base plate 14 and face plate 12 to maintain face plate 12 in spaced relation relative to base plate 14. Face plate 12, base plate 14 and spacers 16 can comprise, for example, glass. Phosphor regions 18, 20, and 22 are associated with face plate 12, and separated from face plate 12 by a transparent conductive layer 24. Transparent conductive layer 24 can comprise, for example, indium tin oxide or tin oxide. Phosphor regions 18, 20, and 22 comprise phosphor-containing masses. Each of phosphor regions 18, 20, and 22 can comprise a different color phosphor. Typically, the phosphor regions comprise either red, green or blue phosphor. A black matrix material 26 is provided to separate phosphor regions 18, 20, and 22 from one another. The three phosphor colors (red, green, and blue) can be utilized to generate a wide array of screen colors by simultaneously stimulating one or more of the red, green and blue regions.

Base plate 14 has emitter regions 28, 30 and 32 associated therewith. The emitter regions comprise emitters or field emitter tips 34 which are located within apertures 36 (only some of which are labeled) formed through a conductive gate layer or row line 38 and a lower insulating layer 40. Emitters 34 are typically about 1 micron high, and are separated from base plate 14 by a conductive layer 42. Emitters 34 and apertures 36 are connected with circuitry (not shown) enabling column and row addressing of the emitters 34 and apertures 36, respectively.

A voltage source 44 is provided to apply a voltage differential between emitters 34 and surrounding gate apertures 36. Application of such voltage differential causes electron streams 46, 48, and 50 to be emitted toward phosphor regions 18, 20, and 22 respectively. Conductive layer 24 is charged to a potential higher than that applied to gate layer 38, and thus functions as an anode toward which the emitted electrons accelerate. Once the emitted electrons contact phosphor dots associated with regions 18, 20, and 22 light is emitted. As discussed above, the emitters 34 are typically matrix addressable via circuitry. Emitters 34 can thus be selectively activated to display a desired image on the phosphor-coated screen of face plate 12.

The emitter tips are typically connected to a conductive column line for energizing selected tips. Further, current limiting resistors, typically comprising doped silicon or silicon-containing material are positioned intermediate the emitter tips and column lines to reduce current and avoid burning up the emitter tips. Various aspects of current-limiting resistors and, more generally, field emitter display assemblies are described in the following U.S. patents, the disclosures of which are incorporated by reference herein: U.S. Pat. Nos. 5,712,534, 5,642,017, 5,644,195, 5,652,181, and 5,663,742.

Referring to FIGS. 2–7, various aspects of a field emitter display (FED) assembly in accordance with the prior art are described.

Referring to FIG. 2, a substrate 52 is provided and has a plurality of column lines 54 formed or supported thereover. The substrate can comprise any suitable substrate, with exemplary substrate materials being disclosed in one or more of the patents incorporated by reference in this document. Column lines 54 typically comprise a conductive material such as a conductive metal. Exemplary materials can include materials which are disclosed in one or more of the patents incorporated by reference in this document.

Referring to FIG. 3, a plurality of resistor islands 56 are formed over the conductive lines. Resistor islands 56 typically comprise a silicon-containing material such as polysilicon. Other materials can be used. The resistor islands can be formed through suitable patterning and etching techniques which are known. As shown in FIGS. 3 and 6, individual resistor islands 56 are received entirely within their associated column lines 54. In addition, a plurality of discrete resistors are formed for each column line.

Referring to FIGS. 4 and 7, field emitter regions 58 are formed over resistor islands 56 in accordance with known techniques described in one or more of the above patents. One or more field emitter regions can be formed for each resistor island. The field emitter regions, as perhaps best shown in FIG. 7, comprise a plurality of field emitter tips 60.

Referring to FIG. 5, conductive grids or row lines 62 are formed over the substrate in accordance with known techniques. A plurality of windows 64 are provided through grid 62. The windows expose the individual field emitter regions 58. Each window defines a single pixel having 100 or more field emitter tips thereon. Each individual resistor island 56 is received completely within their associated illustrated window.

Up to now, problems have existed in such constructions regarding current leakage arcs and shorts between row and column lines, e.g. grid 62 and column lines 54, even though such lines are spaced and separated by a dielectric insulator material. These shorts and leakage arcs can be most pronounced at the edges of the row and column lines.

Accordingly, this invention arose out of concerns associated with providing improved field emitter display (FED) assemblies and methods of forming field emitter display (FED) assemblies.

SUMMARY OF THE INVENTION

Field emitter display (FED) assemblies and methods of forming field emitter display (FED) assemblies are described. In one embodiment, a substrate is provided having a column line formed and supported thereby. A plurality of field emitter tip regions are formed and disposed in operable proximity to the column line. At least some of the regions define different pixels of the display. A continuous resistor is interposed between the column line and at least two different pixels.

In another embodiment, a column line is formed and supported by a substrate. A plurality of field emitter tip regions are formed and disposed in operable proximity to the column line. The regions define different pixels of the display. A single current-limiting resistor is operably coupled with the column line and at least two different pixels.

In yet another embodiment, a series of column lines are formed over a substrate. A series of field emitter tip regions are formed and arranged into discrete pixels which are disposed in operable proximity to individual respective column lines. A series of resistor strips is formed and supported by the substrate. The resistor strips individually underlie respective individual series of field emitter tip regions. The individual resistor strips operably connect respective column lines and field emitter tip regions. At least one of the resistor strips operably connects its associated column line and at least two different discrete pixels.

In still another embodiment, an elongate column line is formed over a substrate. The column line has a transverse width. An elongate resistor is formed over the substrate in operable connection with the elongate column line. The elongate resistor has a transverse width which is greater than the transverse width of the elongate column line. At least one region of field emitter tips is formed and supported by the substrate in operable connection with the elongate resistor. Other embodiments are described.

BRIEF DESCRIPTION OF THE DRAWINGS

Preferred embodiments of the invention are described below with reference to the following accompanying drawings.

FIG. 10 is a view of the FIG. 8 assembly at a processing step which is subsequent to that which is shown in FIG. 9.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Referring to FIGS. 8–14, one or more embodiments of the present invention are shown. Like numerals from the above-described prior art embodiment are utilized where appropriate, with differences being indicated by the suffix "a".

Figure 13:
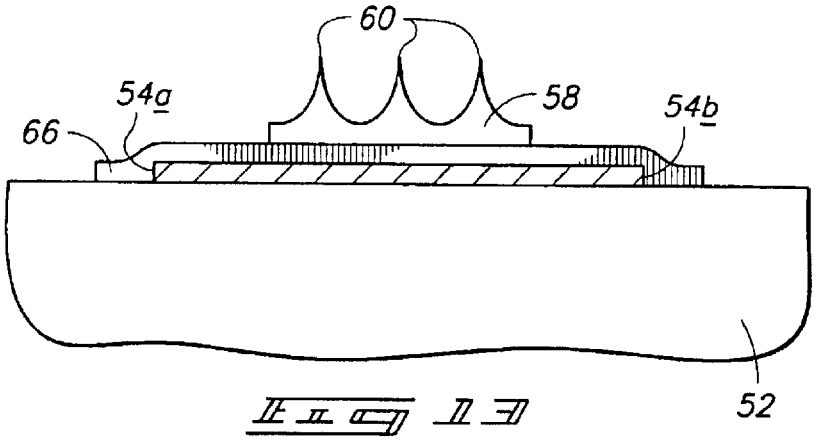
FIG. 13 is a view which is taken along line 13—13 in FIG. 10.

In one embodiment, field emitter display (FED) assembly is provided and includes a substrate 52, and a plurality of column lines 54 which are formed and supported thereby. A plurality of field emitter tip regions 58 (FIG. 10) are disposed in operable proximity to individual column lines 54. At least some of the individual regions define different pixels of the display. In this illustrated example, each separate field emitter tip region 58 comprises a different pixel of the display, as will become apparent below. A continuous resistor, and preferably a plurality of continuous resistors 66 (FIGS. 9 and 13) are provided. In this example, and as best shown in FIG. 13, resistor 66 is interposed between column line 54 and at least two different pixels comprised of the field emitter tip regions 58. In one embodiment, resistor 66 comprises a silicon-containing material, and preferably a silicon-containing material containing a conductivity-modifying impurity. Exemplary materials and impurities are described in one or more of the patents incorporated by reference above.

Figure 9:
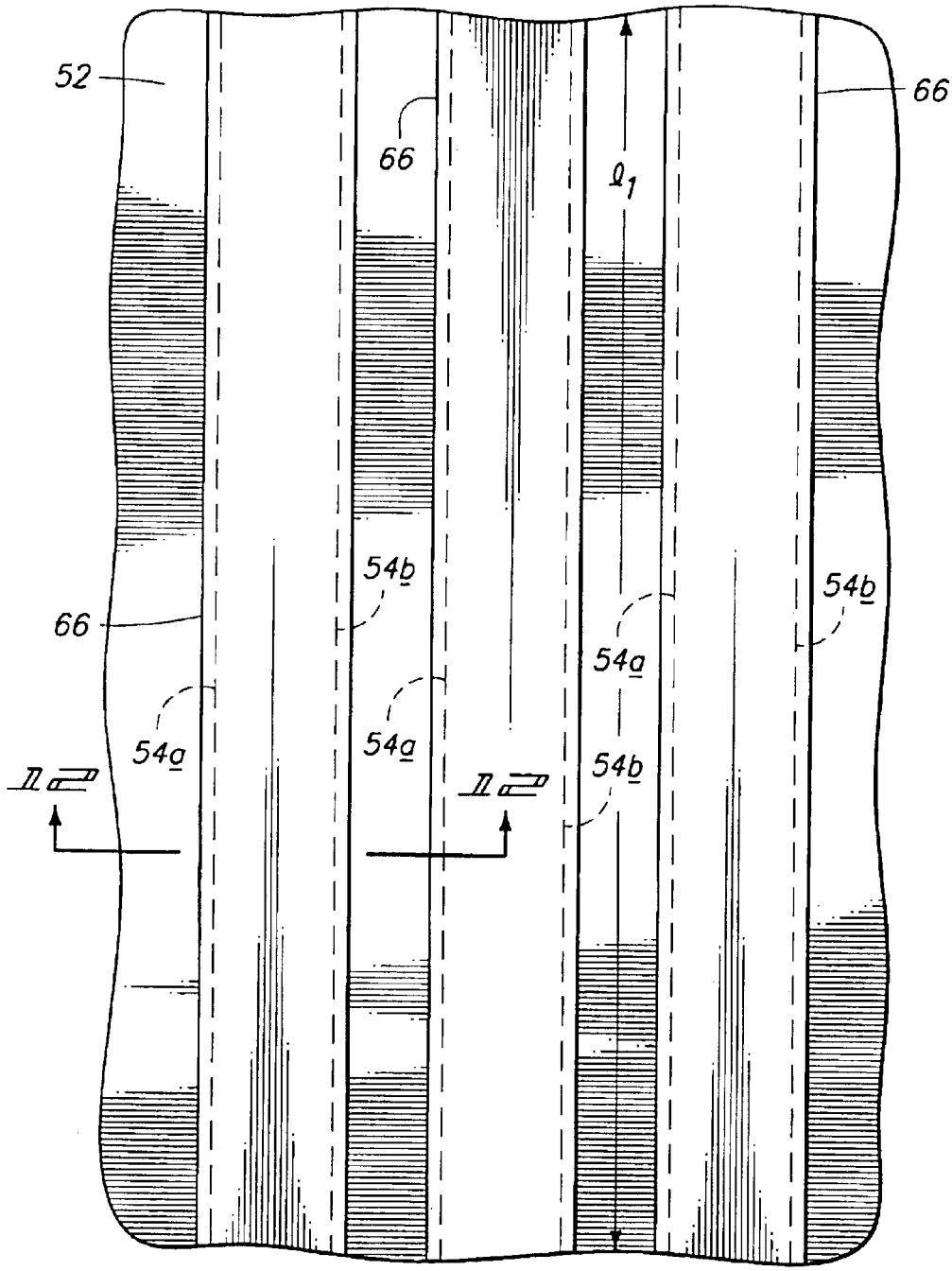
FIG. 9 is a view of the FIG. 8 assembly at a processing step which is subsequent to that which is shown in FIG. 8.
Figure 11:
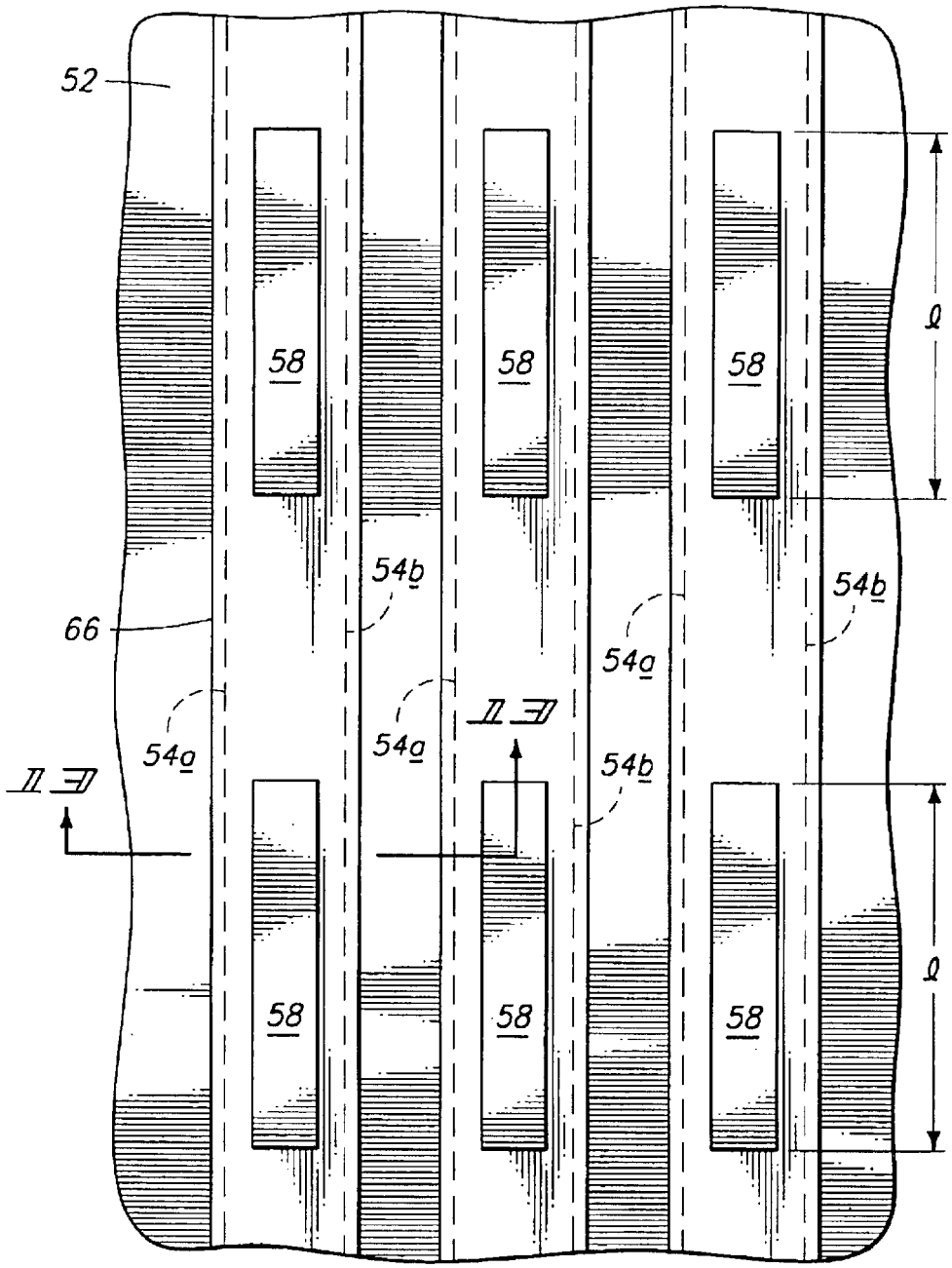
FIG. 11 is a view of the FIG. 8 assembly at a processing step which is subsequent to that which is shown in FIG. 10.
Figure 11:
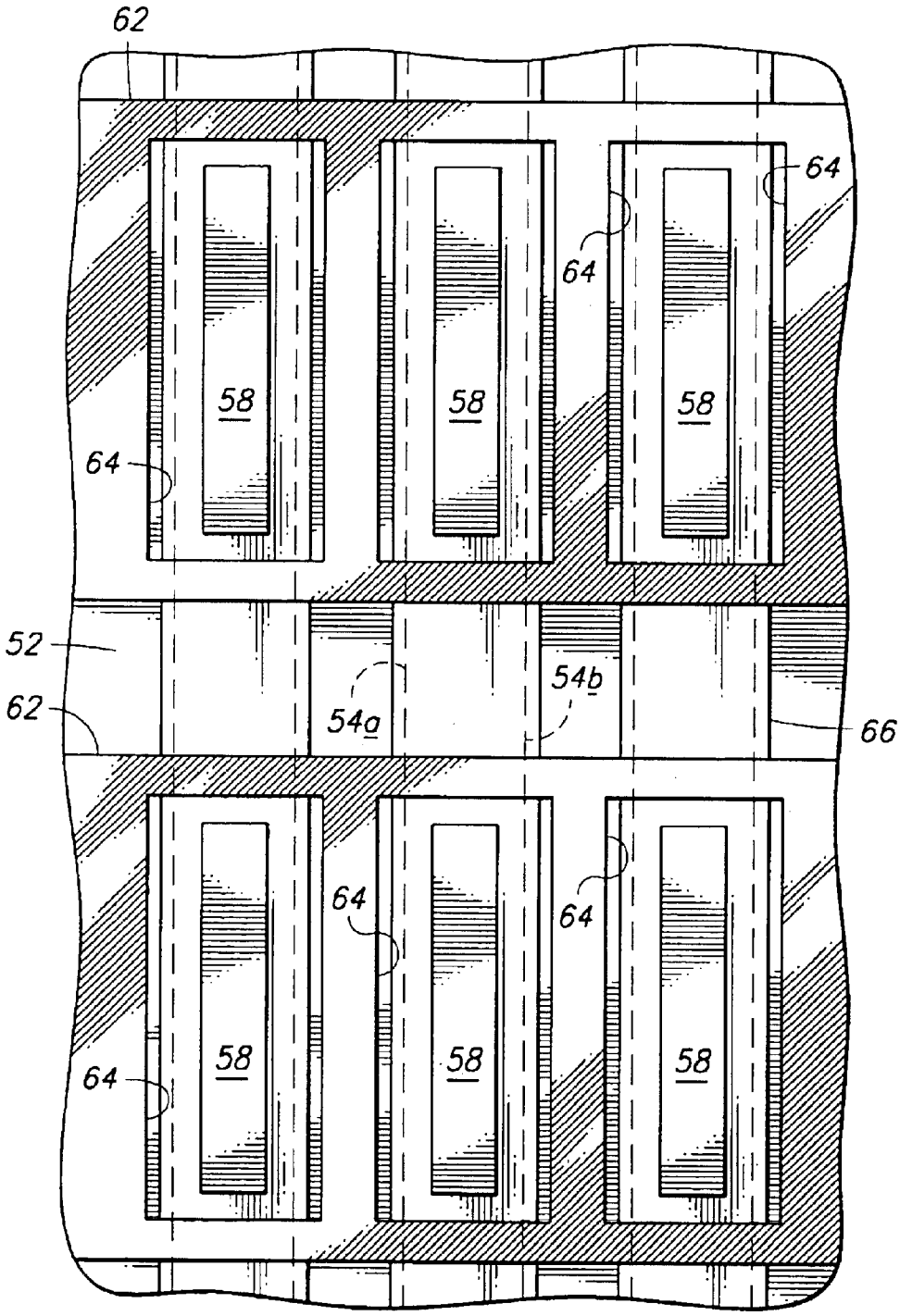

In another embodiment, at least two different pixels have individual lengths, and resistor 66 has a length which is no less than the combined lengths of the two different pixels. For example, in FIG. 10, the rightmost pixels each have a length l. Resistor 66, as shown in FIG. 9, has a length $l_l$ which extends the entire length of the page upon which FIG. 9 appears. Accordingly, this resistor's length is greater than the combined lengths of the two different pixels in FIG. 10.

Figure 12:
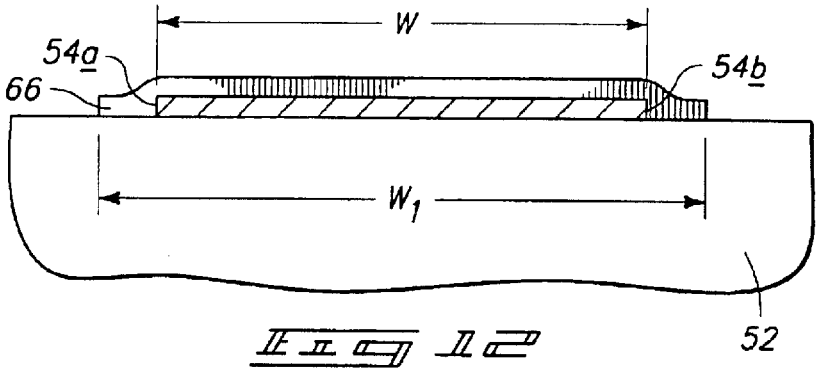
FIG. 12 is a view which is taken along line 12—12 in FIG. 9.

In another embodiment, each individual column line has a pair of oppositely-facing sides 54*a*, 54*b* respectively. The sides are joined with substrate 52 as shown in FIGS. 12 and 13. Resistor 66 preferably comprises a material which is disposed over at least a portion of at least one side 54*a*, 54*b* respectively, of column line 54. In another embodiment, the resistor material is disposed over an entirety of at least one side. In the illustrated example, resistor material 66 is disposed over an entirety of side 54*a*. In yet another embodiment, the resistor material is disposed over an entirety of one side and on the substrate adjacent the one side. In this example, a portion of resistor 66 is seen to be disposed laterally adjacent side 54*a*.

In still another embodiment, resistor 66 comprises a material which is disposed over at least a portion of both of sides 54*a*, 54*b*. In one embodiment, the resistor material is disposed over an entirety of both of sides 54*a*, 54*b*. In another embodiment, the resistor material is disposed over an entirety of both of sides 54*a*, 54*b*, and on substrate 52 adjacent both of the respective sides. In the illustrated example of FIG. 12, resistor material is seen to be disposed on substrate 52 laterally adjacent both sides 54*a*, 54*b* respectively.

In a preferred embodiment, resistor 66 is interposed between the column line and all of the different pixels operably proximate the column line.

In another embodiment, a field emitter display (FED) assembly is provided and includes a substrate 52, a plurality of column lines 54 disposed over substrate 52, and a plurality of field emitter tip regions 58 disposed in operably proximity to the respective column lines 54. Field emitter tip regions 58 preferably define different pixels of the display. Preferably, a single current-limiting resistor is operably coupled with a column line and at least two different pixels of that column line. Preferably, a plurality of single current-limiting resistors are provided, with each being operably coupled with a different respective column line and at least two of their associated different pixels.

In but one example, a suitable current-limiting resistor is shown in FIGS. 12 and 13 at 66. Other current-limiting resistors can, of course, be used. In this illustrated example, resistor 66 preferably comprises a silicon-containing material.

Figure 14:
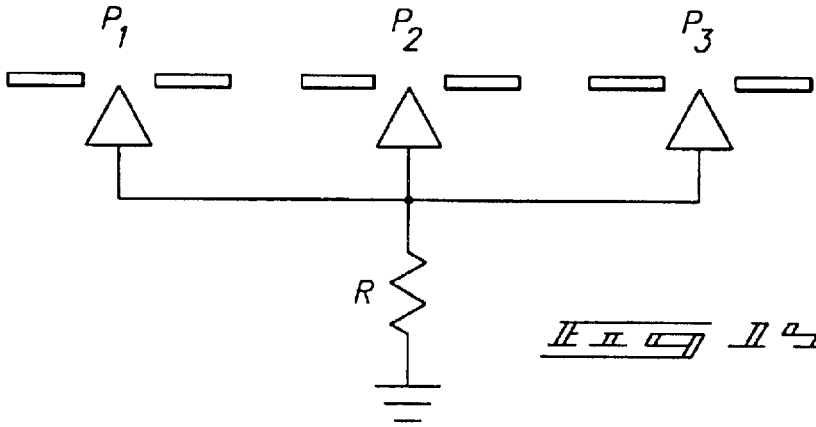
FIG. 14 is a high-level schematic view of a circuit in accordance with one embodiment of the invention.

In one embodiment, the single current-limiting resistor 66 is coupled with more than two different pixels of a column line. Such is schematically shown in FIG. 14 where the current-limiting resistor is shown at R, and individual different pixels of one column line are shown at $P_1$, $P_2$, and $P_3$ respectively. In another embodiment, current-limiting resistor 66 is coupled with all of the pixels disposed in operable proximity with a respective column line.

The current-limiting resistor can take many forms without departing from the spirit and scope of the invention. For example, in one embodiment shown in FIGS. 12 and 13, resistor 66 is disposed over column line 54. In another embodiment, resistor 66 is disposed under field emitter tip regions 58. In yet another embodiment, resistor 66 is disposed between column line 54 and field emitter tip regions 58.

In still another embodiment, column line 54 has a width w (FIG. 12). Resistor 66 is preferably disposed over column line 54 and completely covers at least a portion of the column line width. In this illustrated example, resistor 66 covers an entire portion of column line width w.

In another embodiment, a field emitter display (FED) assembly is provided and includes a substrate 52 having a series of column lines 54 (FIG. 8) supported thereby. A series of field emitter tip regions 58 is provided, with the regions being arranged into discrete pixels which are disposed in operably proximity with individual respective column lines. A series of resistor strips 66 (FIG. 9) is provided and supported by substrate 52. The resistor strips 66 individually underlie their respective individual series of field emitter tip regions 58 as shown in FIG. 13. The individual resistor strips 66 operably connect their respective column lines 54 and their associated field emitter tip regions 58. Preferably, at least one of the resistor strips operably connects its associated column line and at least two different discrete pixels. In one embodiment, a plurality of the resistor strips 66 operably connect their individual associated column lines 54 and at least two different discrete pixels which are associated with the respective column lines. In yet another embodiment, at least one resistor strip 66 operably connects its associated column line with all of the pixels associated with the column line. In still another embodiment, a plurality of resistor strips operably connect their individual associated column lines and at least two different discrete pixels which are associated with the respective column lines. In this embodiment, at least one of the resistor strips operably connects its associated column line with all of the pixels associated with the column line.

In another embodiment, column lines 54 and resistor strips 66 are elongate in a common direction. The column lines 54 have transverse widths w (FIG. 12), and resistor strips 66 have transverse widths $w_1$. Preferably, width $w_1$ is greater than width w. In one transverse width embodiment, a plurality of the resistor strips operably connect their individual associated column lines and at least two different discrete pixels which are associated with the respective column lines. In another transverse width embodiment, each resistor strip operably connects its associated column line with all of the pixels which are associated with that particular associated column line. In yet another transverse width embodiment, at least one of the resistor strips completely covers a substantial portion of its associated column line. In still another transverse width embodiment, a plurality of resistor strips completely cover substantial portions of their respective associated column lines. In yet another transverse width embodiment, all of the resistor strips completely cover substantial portions of their respective associated column lines.

In another embodiment, a field emitter display (FED) assembly includes a substrate 52 and at least one, and preferably more elongate column lines 54 supported by the substrate and having respective transverse widths w. At least one, and preferably more elongate resistors 66 are provided and supported by the substrate in operable connection with associated respective elongate column lines 54. Each elongate resistor 66 has a transverse width $w_1$ (FIG. 12) which is preferably greater than the transverse width w of its associated elongate column line 54. At least one region of field emitter tips 58 are supported by the substrate in operable connection with elongate resistor 66. In one embodiment, a plurality of regions of field emitter tips are provided and are arranged to define different pixels of the display.

In another embodiment, column line 54 and elongate resistor 66 extend in a common direction. Preferably, elongate resistor 66 is received over elongate column line 54 as shown in FIGS. 12 and 13. In yet another embodiment, elongate resistor 66 is received over elongate column line 54 and covers a substantial portion of the column line. In still another embodiment, a plurality of regions of field emitter tips are provided and arranged to define different pixels of the display. The elongate resistor is preferably received over the elongate column line 54 and covers a substantial portion of the column line. In another embodiment, a plurality of regions of field emitter tips are provided and arranged to define different pixels of the display. Column line 54 and elongate resistor 66 extend in a common direction, with the elongate resistor being received over elongate column line 54 and covering a substantial portion thereof.

In another embodiment, a field emitter display (FED) assembly is provided comprising a substrate 52. At least one, and preferably a plurality of column lines 54 are supported by the substrate. A plurality of field emitter tip regions 58 are disposed in operable proximity to each column line 54, with at least some of the regions 58 defining different pixels of the display. Preferably a plurality of resistors are provided and supported by substrate 52 over their individual respective column lines 54 and operably connected therewith. A row line 62, and preferably a plurality of row lines 62 (FIG. 11) are supported by substrate 52 elevationally over the column line or lines. Each row line 62 has a pair of edges which define individual width dimensions. The edges of the row lines are not specifically designated in the drawings, but run horizontally across the page upon which FIG. 11 appears. Preferably, the resistor extends laterally beyond at least one of the edges. In this particular embodiment, an exemplary resistor is shown at 66 in FIG. 11. This resistor extends laterally beyond the bottommost edge of the upper row line into an area between adjacent row lines. Preferably, the resistor extends laterally beyond both edges. Here, resistor 66 is seen to extend beyond the uppermost and bottommost edges of the upper row line. Preferably, the resistor operably connects the column line and at least two different pixels associated with that column line. In one embodiment, the resistor comprises a silicon-containing material. Other materials can, of course, be used.

In another embodiment a field emitter display (FED) assembly is provided and includes a substrate 52 and at least one, and preferably more column lines 54 supported by the substrate. A plurality of field emitter tip regions 58 are provided and disposed in operably proximity to associated respective column lines. The regions define different pixels of the display. A current-limiting resistor is preferably received within a pixel of a column line between individual field emitter tip regions 58 and the column line. The current-limiting resistor is preferably continuous between at least two different pixels of the column line. In one embodiment, the current-limiting resistor is continuous between all of the pixels for the column line. In another embodiment, a row line 62 is provided and supported by the substrate elevationally over one or more column lines. The row line preferably has a pair of edges which define a width dimension, and the current-limiting resistor extends laterally beyond at least one, and preferably both of the edges.

In accordance with other embodiments of the invention, methods of forming field emitter display (FED) assemblies are provided.

In one embodiment, a substrate 52 is provided and a column line 54 (FIG. 8) is formed thereover. A plurality of field emitter tip regions 58 are formed and disposed in operably proximity to column line 54. At least some of the regions define different pixels of the display. A continuous resistor 66 is interposed between the column line and at least two different pixels. In one embodiment, resistor 66 is interposed prior to forming the plurality of field emitter tip regions. Such is preferably accomplished by forming at least one layer of resistive material 66 (FIGS. 12 and 13) over at least a portion of column line 54. In another embodiment, resistor 66 is interposed between all of the pixels for a column line and the column line. In still another embodiment, the column line is formed to be elongate and has a transverse width w (FIG. 12). The continuous resistor is interposed by forming an elongate resistor having a transverse width $w_1$ which is greater than the transverse width of column line 54.

Figure 1:
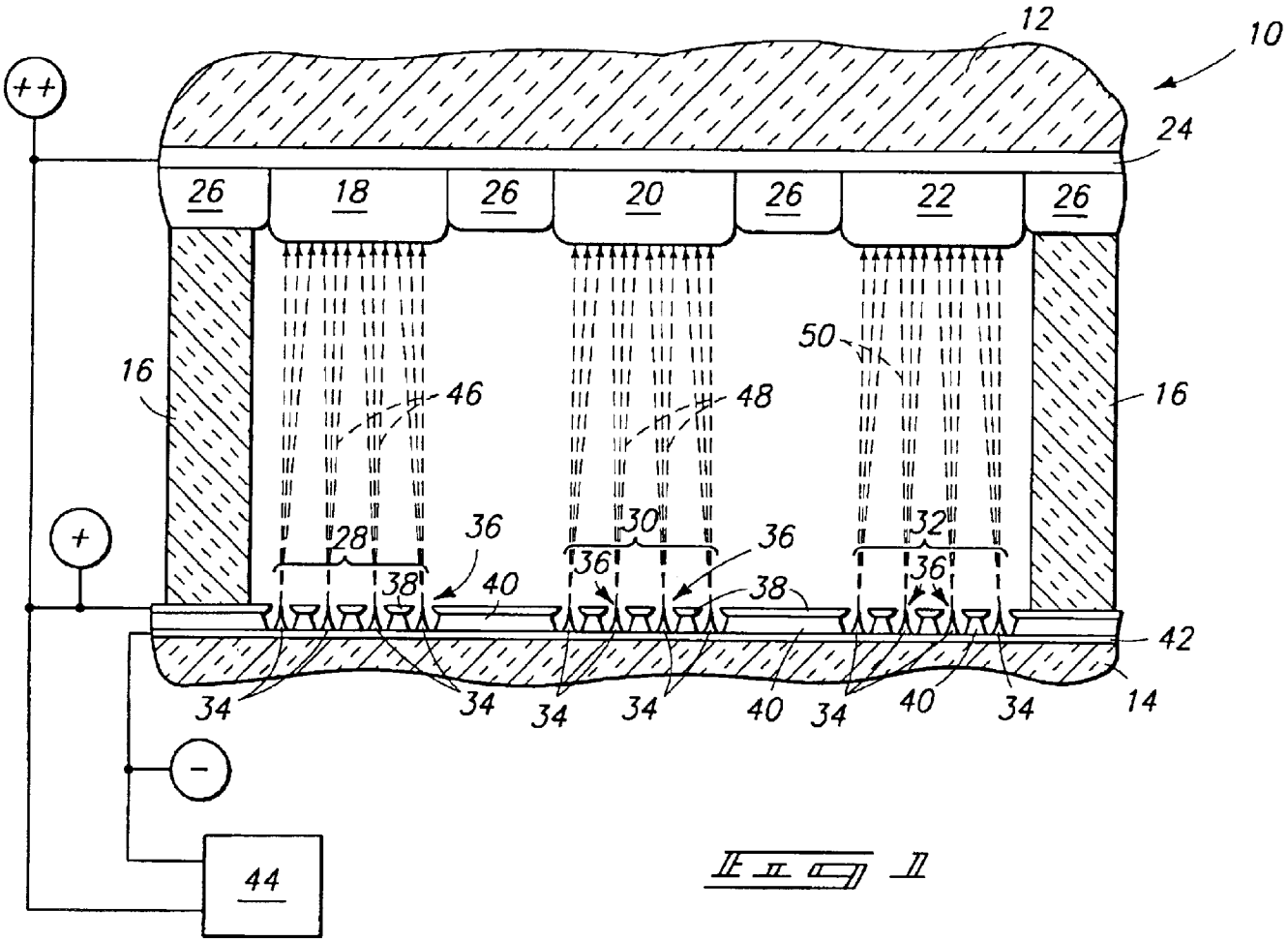
FIG. 1 is a side sectional view of a portion of an exemplary field emission display (FED) device which can be constructed in accordance with one or more embodiments of the present invention.
Figure 2:
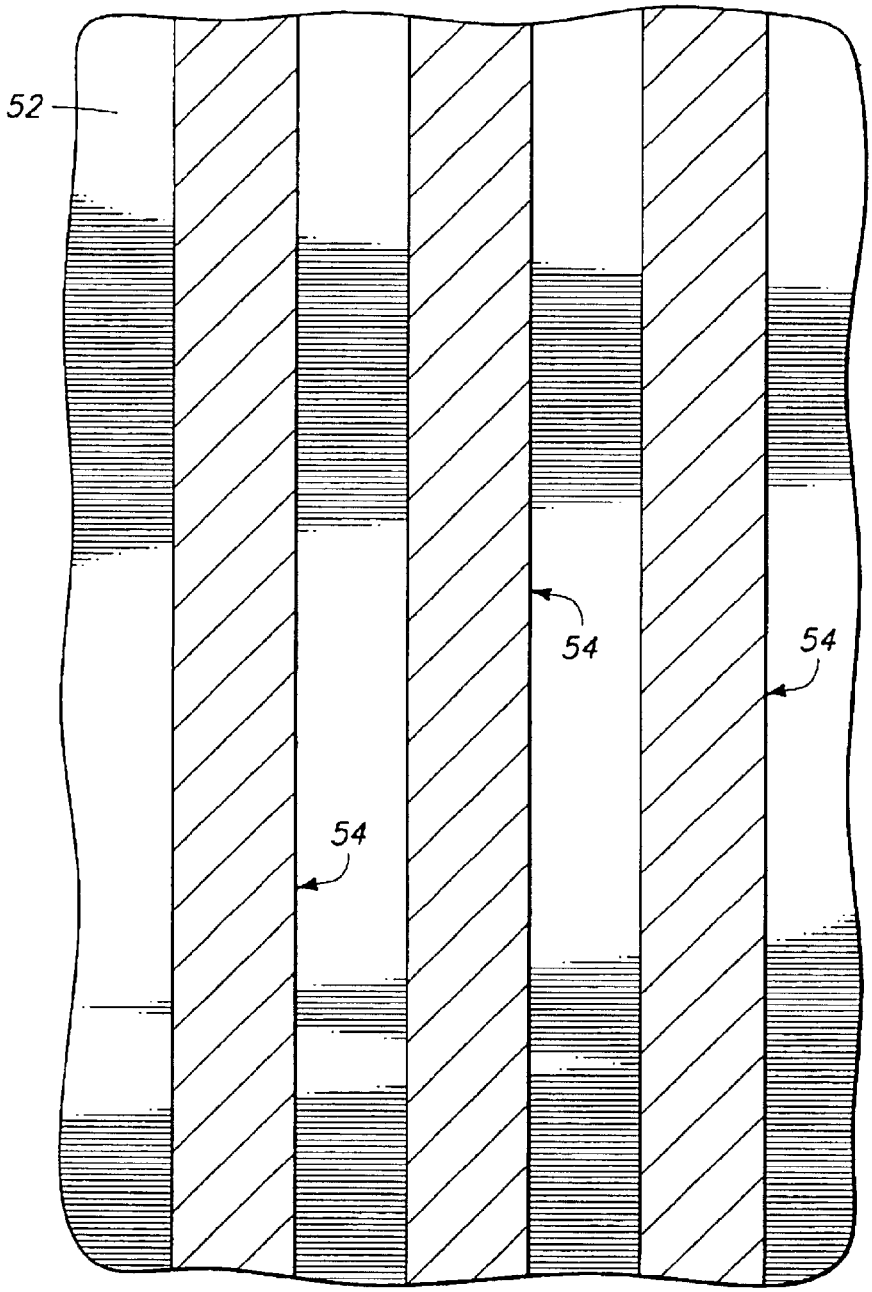
Fig 2 PRIOR ART
FIG. 2 is a top plan view of a field emitter display (FED) assembly undergoing processing in accordance with the prior art.
Figure 3:
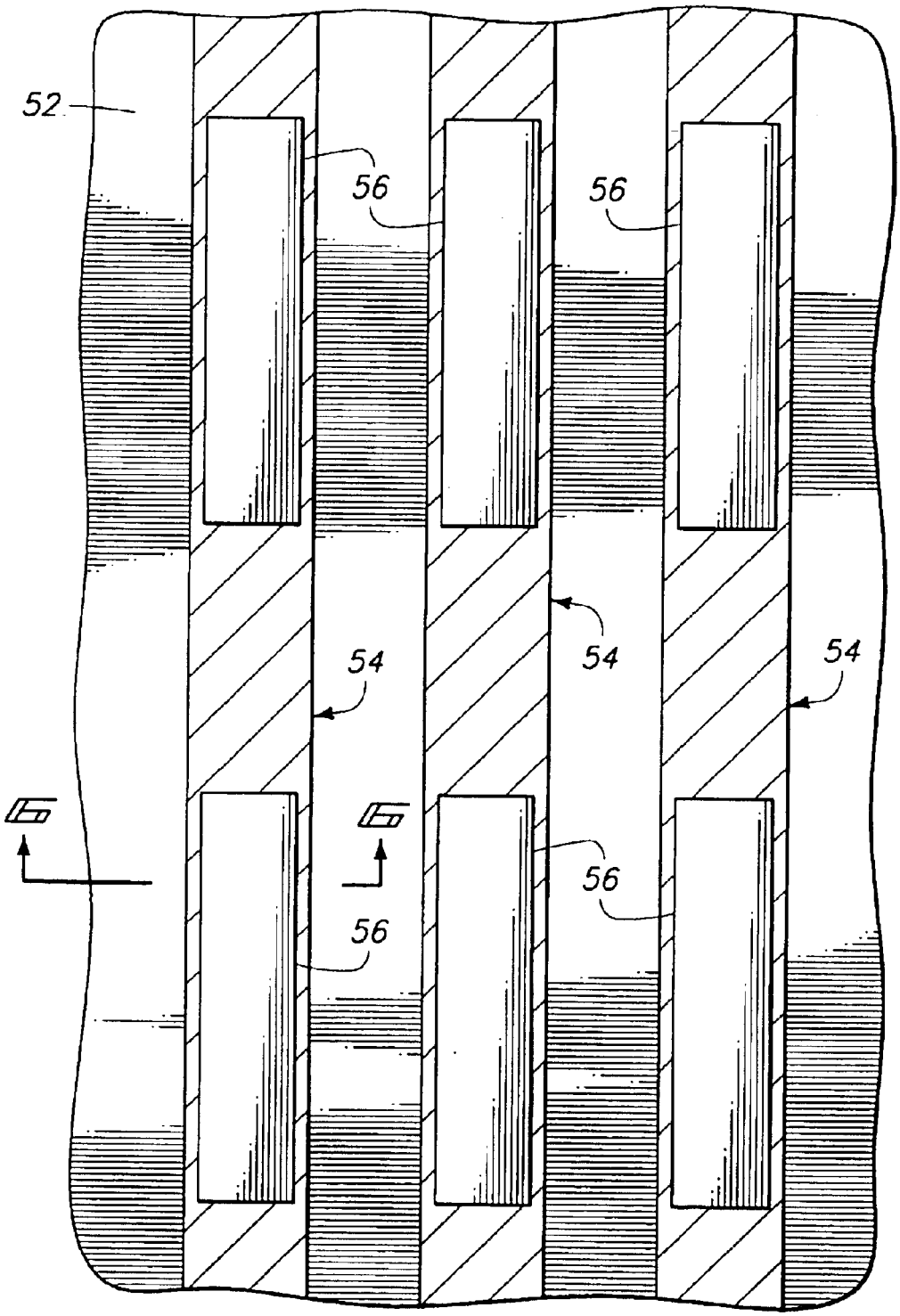
FIG 3 PRIOR ART
FIG. 3 is a view of the FIG. 2 assembly at a processing step which is subsequent to that which is shown in FIG. 2.
Figure 4:
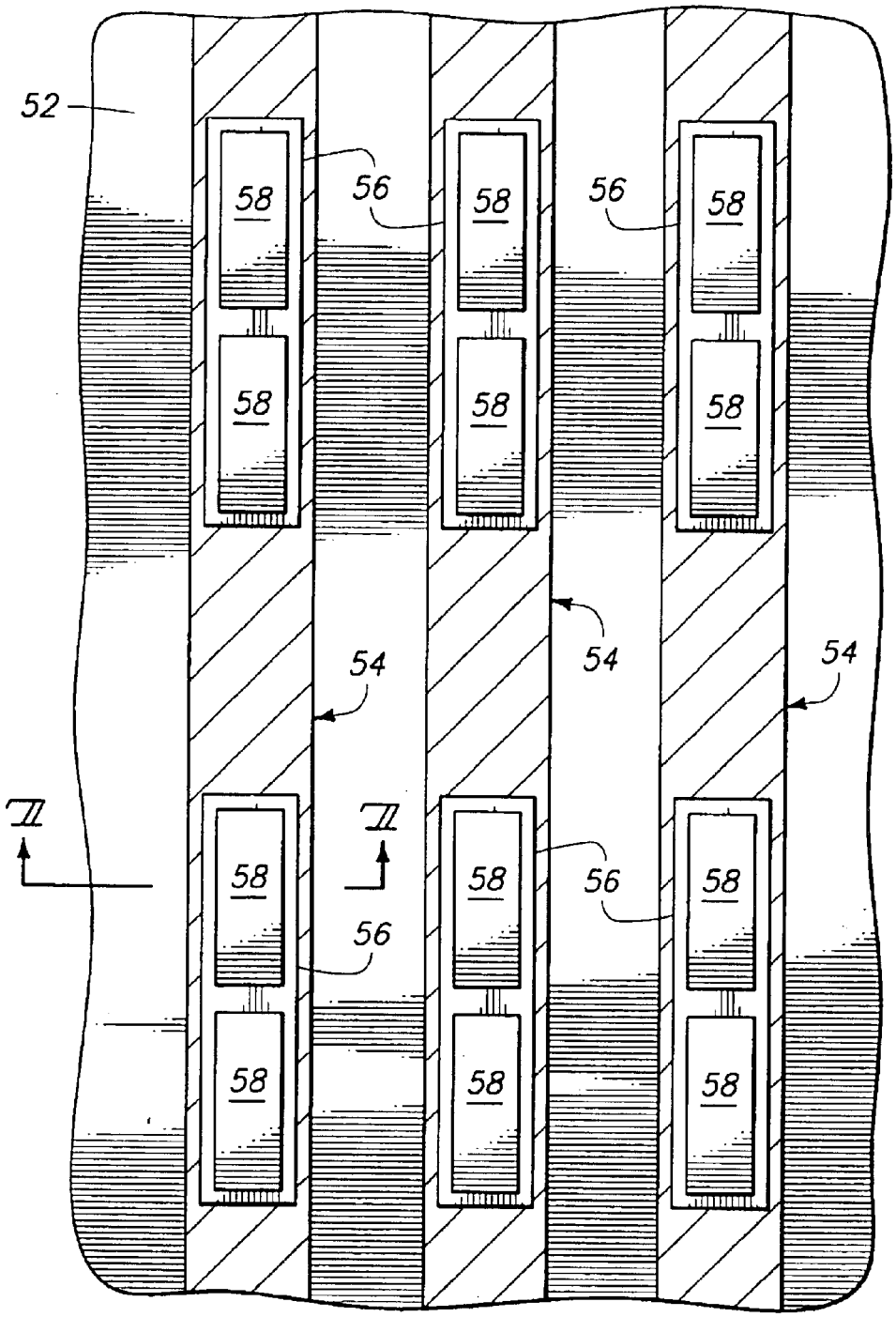
Fig 4 PRIOR ART
FIG. 4 is a view of the FIG. 2 assembly at a processing step which is subsequent to that which is shown in FIG. 3.
Figure 5:
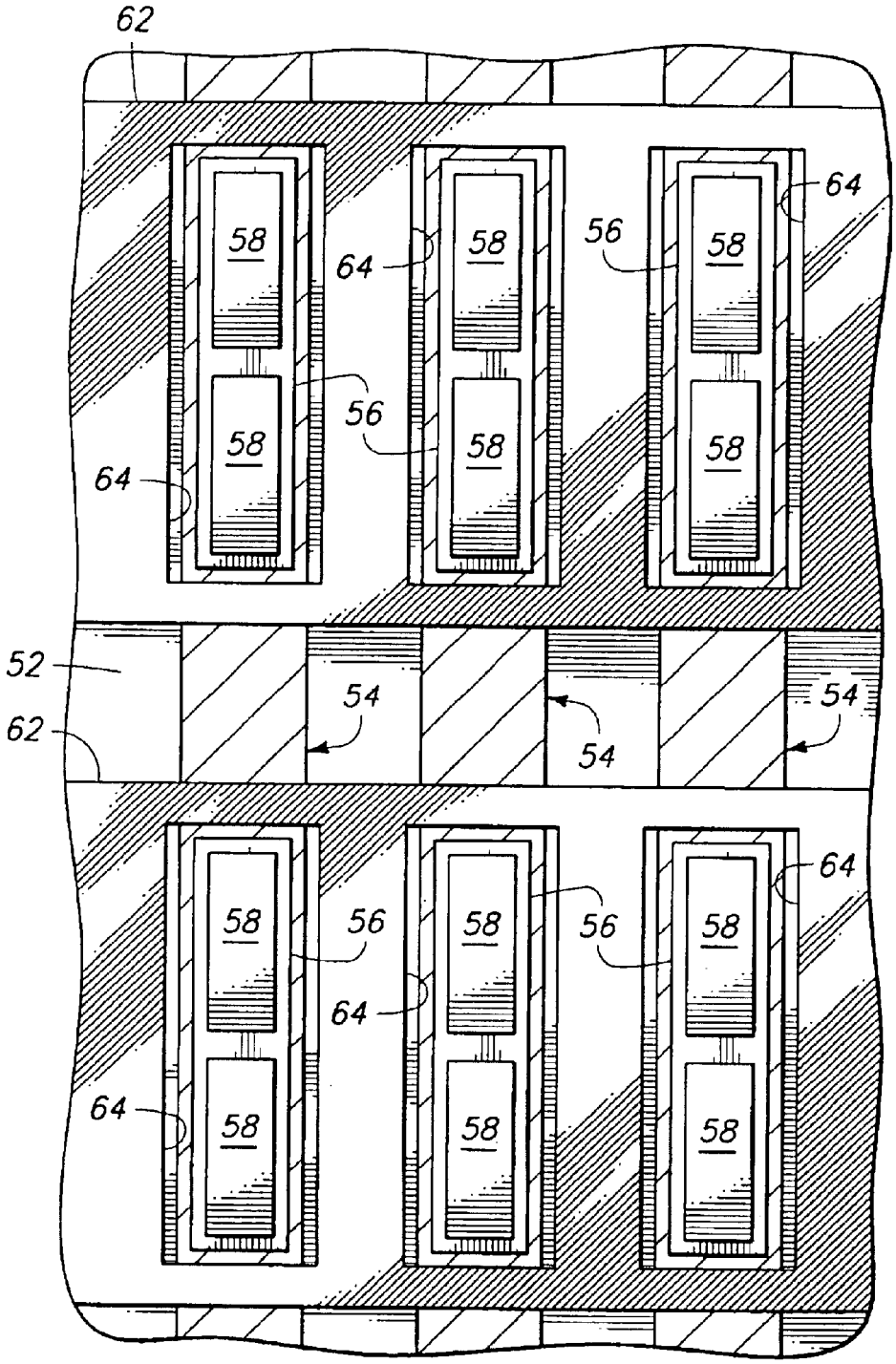
Fig 5 PRIOR ART
FIG. 5 is a view of the FIG. 2 assembly at a processing step which is subsequent to that which is shown in FIG. 4.
Figure 6:
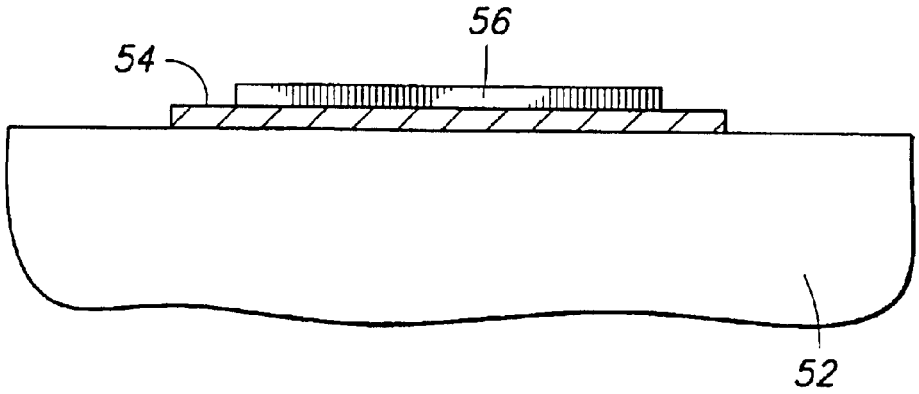
FIG 6 PRIOR ART
FIG. 6 is a view which is taken along lines 6—6 in FIG. 3.
Figure 7:
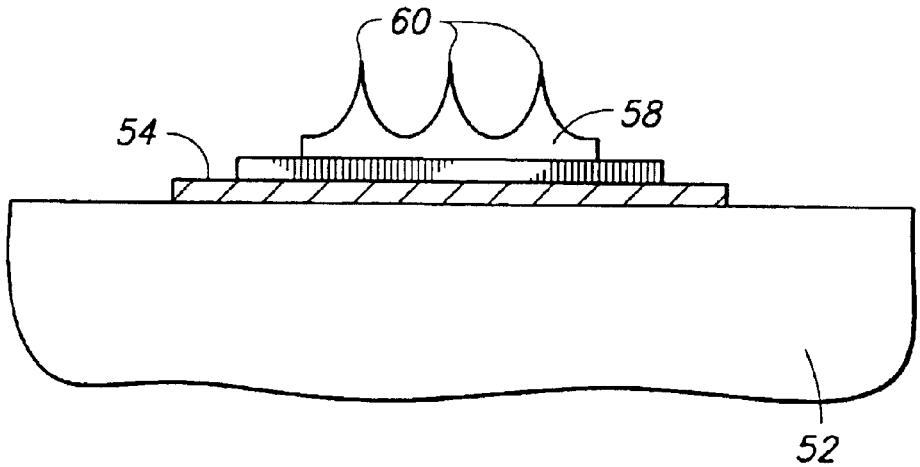
FIG 7 PRIOR ART
FIG. 7 is a view which is taken along lines 7—7 in FIG. 4.
Figure 8:
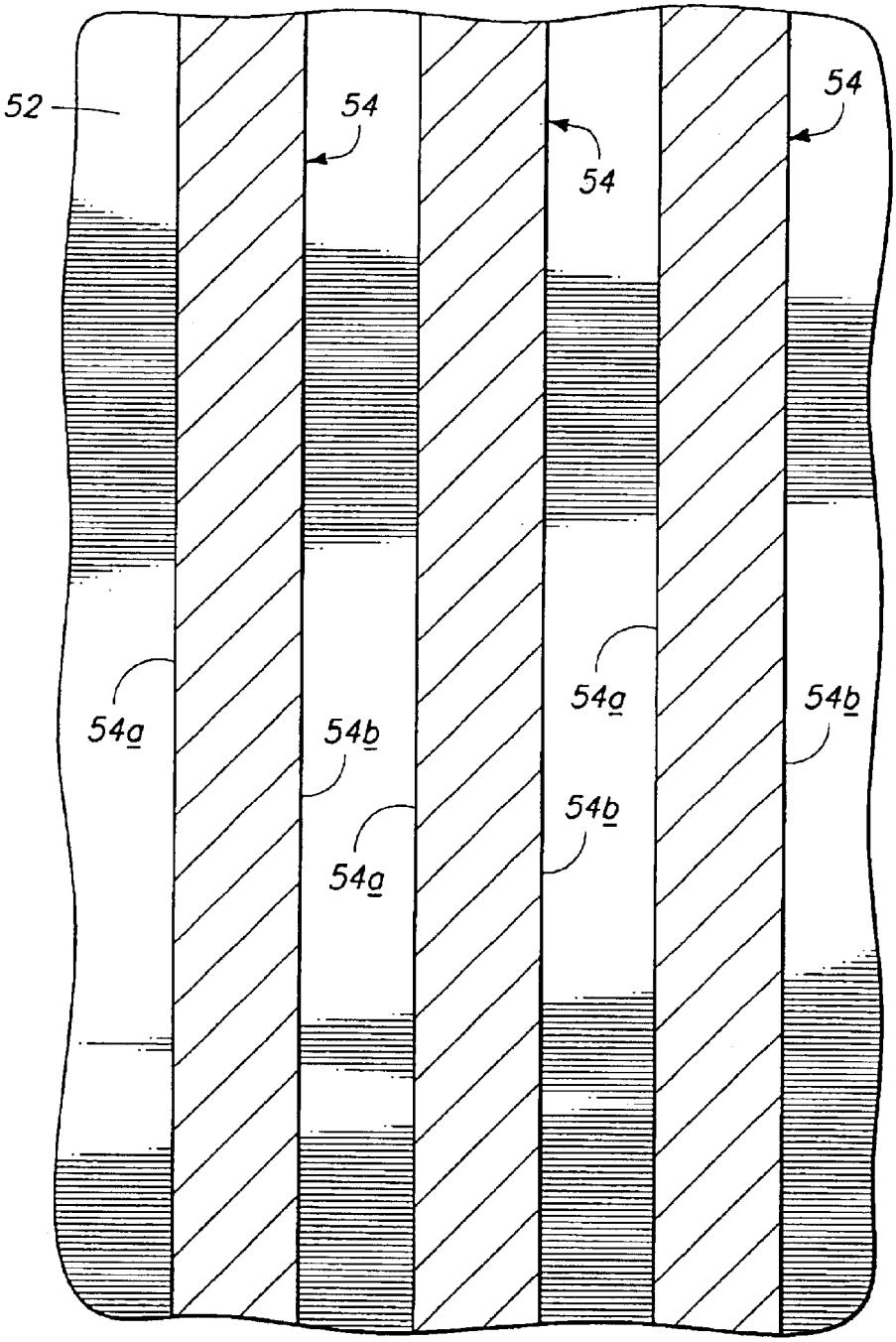
FIG. 8 is a top plan view of a field emitter display (FED) assembly undergoing processing in accordance with one or more embodiments of the present invention.

In yet another embodiment, the transverse width of column line 54 is defined between a pair of oppositely-facing sides 54*a*, 54*b* (FIG. 8). Resistor 66 is provided by forming a layer of resistive material (FIGS. 12 and 13) over at least one of the column line's sides 54*a*, 54*b*. In another embodiment, the resistive material is formed over both of the column line's sides 54*a*, 54*b*.

In another embodiment, a method of forming a field emitter display (FED) assembly comprises providing a substrate 52 and forming a column line 54 thereover. A plurality of field emitter tip regions 58 are formed and disposed in operable proximity to column line 54. The regions preferably define different pixels of the display. A single current-limiting resistor 66 is coupled with column line 54 and at least two different pixels. In one embodiment, the resistor is coupled with the column line and all of the pixels for that column line. In one embodiment, and prior to coupling the resistor with the column line and the pixels, at least a portion of the resistor is provided by forming at least one layer of resistive material, preferably silicon-containing material, over the substrate.

In another embodiment, a method of forming a field emitter display (FED) assembly comprises providing a substrate 52, and forming an elongate column line 54 over the substrate. The column line preferably has a transverse width w, and an elongate resistor 66 is formed over the elongate column line 54 having a transverse width $w_1$. Preferably, the transverse width of the elongate resistor is greater than the transverse width of the elongate column line 54. At least one field emitter tip region 58 is formed over elongate resistor 66. In one embodiment, the resistor is formed to cover a substantial portion of the elongate column line 54. In another embodiment, elongate column line 54 and elongate resistor 66 are formed to be elongate in a common direction. In another embodiment, the column line and resistor are formed to be elongate in a common direction, and the resistor is formed to cover a substantial portion of the column line.

In yet another embodiment, column line 54 is formed to have a pair of oppositely-facing sides 54*a*, 54*b* which define a width dimension w therebetween. The resistor 66 is formed over the substrate, at least a portion of which is formed to cover at least one of the column line's sides. Field emitter tip region 58 is preferably formed over resistor 66. In one embodiment, the resistor is formed to cover both of the column line's sides. In another embodiment, the resistor is formed to have a width dimension which is at least as great as the width dimension of the column line. In yet another embodiment, the resistor is formed to have a width dimension which is greater than the width dimension of the column line. In another embodiment, the resistor is formed to have a width dimension which is greater than the width dimension of the column line and sufficient to cover both of the column line's sides 54*a*, 54*b*.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A field emitter display (FED) assembly comprising:

a substrate;

a column line devoid of openings and supported by the substrate and comprising an upper surface connecting two sides extending from the substrate;

a plurality of field emitter tip regions disposed in operable proximity to the column line, at least some of the regions defining different pixels of the display;

a continuous resistor interposed between the column line and at least two different pixels; and wherein the continuous resistor comprises a material which is disposed over an entirety of the upper surface and over at least a portion of each of the two sides of the column line.

2. The field emitter display assembly of claim 1, wherein said at least two different pixels have individual lengths, and wherein the continuous resistor has a length which is no less than the combined lengths of said at least two different pixels.

3. The field emitter display assembly of claim 1, wherein the resistor material is disposed over an entirety of at least one side.

4. The field emitter display assembly of the claim 3, wherein the resistor material is disposed on the substrate adjacent said at least one side.

5. The field emitter display assembly of claim 1, wherein the resistor material is disposed over an entirety of both of said sides.

6. The field emitter display assembly of claim 1, wherein the resistor material is disposed on the substrate adjacent both of said sides.

7. The field emitter display assembly of claim 1, wherein the continuous resistor is interposed between the column line and all of the different pixels operably proximate the column line.

8. A field emitter display (FED) assembly comprising:

a substrate;

a column line supported by the substrate and comprising an upper surface connecting two sidewalls extending from the substrate;

a plurality of field emitter tip regions disposed in operable proximity to the column line, the regions defining different pixels of the display;

a single resistor operably coupled with the column line and at least two different pixels; and wherein the column line has a width, and the single resistor is disposed over the column line and completely covers at least a portion of the column line width by covering an entirety of the upper surface and an entirety of at least one sidewall, the single resistor comprising a terminal end extending along the at least one sidewall of the column line.

9. The field emitter display assembly of claim 8, wherein the resistor comprises a silicon-containing material.

10. The field emitter display assembly of claim 8, wherein the resistor is coupled with more than two different pixels.

11. The field emitter display assembly of claim 8, wherein the resistor is coupled with all of the pixels disposed in operable proximity to the column line.

12. The field emitter display assembly of claim 8, wherein the resistor is disposed over the column line and covers an entirety of the two sidewalls of the column line.

13. The field emitter display assembly of claim 8, wherein the resistor is disposed under the field emitter tip regions.

14. The field emitter display assembly of claim 8, wherein the resistor is disposed between the column line and the field emitter tip regions.

15. A field emitter display (FED) assembly comprising:

a substrate;

a series of column lines supported by the substrate;

a series of field emitter tip regions arranged into discrete pixels which are disposed in operable proximity to individual respective column lines;

a series of resistor strips supported by the substrate and individually underlying respective individual series of field emitter tip regions, individual resistor strips operably connecting respective column lines and field emitter tip regions, at least one of the resistor strips operably connecting its associated column line and at least two different discrete pixels, a portion of each resistor strip disposed on the substrate, and wherein the respective column lines and the respective resistor strips comprise the only structures disposed between the substrate and the respective field emitter tip regions; and wherein the column lines and resistor strips are elongate in a common direction.

16. The field emitter display of claim 15, wherein a plurality of the resistor strips operably connect their individual associated column lines and at least two different discrete pixels which are associated with the respective column lines.

17. The field emitter display of claim 15, wherein said at least one resistor strip operably connects its associated column line with all of the pixels associated with the column line.

18. The field emitter display of claim 15, wherein:

a plurality of the resistor strips operably connect their individual associated column lines and at least two different discrete pixels which are associated with the respective column lines; and wherein said at least one resistor strip operably connects its associated column line with all of the pixels associated with the column line.

19. The field emitter display of claim 15, wherein each resistor strip operably connects its associated column line with all of the pixels which are associated with that particular associated column line.

20. The field emitter display of claim 15, wherein the column lines have transverse widths and the resistor strips have transverse widths which are greater than the transverse widths of the column lines.

21. The field emitter display of claim 20, wherein a plurality of the resistor strips operably connect their individual associated column lines and at least two different discrete pixels which are associated with the respective column lines.

22. The field emitter display of claim 20, wherein each resistor strip operably connects its associated column line with all of the pixels which are associated with that particular associated column line.

23. The field emitter display of claim 22, wherein at least one of the resistor strips completely covers a substantial portion of its associated column line.

24. The field emitter display of claim 22, wherein a plurality of the resistor strips completely cover substantial portions of their respective associated column lines.

25. The field emitter display of claim 22, wherein all of the resistor strips completely cover substantial portions of their respective associated column lines.

26. A field emitter display (FED) assembly comprising:

a substrate;

a column line supported by the substrate and comprising an upper surface connecting two sidewalls extending from the substrate;

a plurality of field emitter tip regions disposed in operably proximity to the column line, the regions defining different pixels of the display; and a resistor received between individual field emitter tip regions and the column line, the resistor being continuous between at least two different pixels, and the resistor disposed over an entirety of the upper surface of the column line, over at least a portion of each of the two sidewalls of the column line and over the substrate, the resistor comprising parallel terminal edges extending along each of the two sidewalls of the column line.

27. The field emitter display (FED) assembly of claim 26, the resistor is continuous between all of the pixels for the column line.

28. The field emitter display (FED) assembly of claim 26 further comprising a row line supported by the substrate elevationally over the column line, the row line having a pair of edges which define a width dimension, and wherein the resistor extends laterally beyond at least one of the edges.

29. The field emitter display (FED) assembly of claim 28, wherein the resistor extends laterally beyond both of the edges of the row line.

* * * * *

UNITED STATES PATENT AND TRADEMARK OFFICE

CERTIFICATE OF CORRECTION

PATENT NO. : 6,822,386 B2
DATED : November 23, 2004
INVENTOR(S) : Derraa

It is certified that error appears in the above-identified patent and that said Letters Patent is hereby corrected as shown below:

Title page,
Item [56], References Cited, FOREIGN PATENT DOCUMENTS, please insert
-- EPO 712149 A2 1996 -- before,
"FR 2750533 1/1998".

Column 12,
Line 8, please insert -- wherein -- before "the".

Signed and Sealed this

Fourth Day of October , 2005

JON W. DUDAS
*Director of the United States Patent and Trademark Office*